US006409617B1

(12) United States Patent
Armold

(10) Patent No.: US 6,409,617 B1
(45) Date of Patent: Jun. 25, 2002

(54) HUNTING ARROW TRACKING SYSTEM

(76) Inventor: Ricky A. Armold, 7897 W. Country Club Blvd., Boca Raton, FL (US) 33487

( * ) Notice: Subject to any disclaimer, the term of this patent is extended or adjusted under 35 U.S.C. 154(b) by 0 days.

(21) Appl. No.: 09/770,257

(22) Filed: Jan. 26, 2001

(51) Int. Cl.[7] ..... F42B 6/04
(52) U.S. Cl. ..... 473/578; 455/98
(58) Field of Search ..... 473/578, 582, 473/583; 342/385, 386; 455/98

(56) References Cited

U.S. PATENT DOCUMENTS

| | | | | |
|---|---|---|---|---|
| 3,790,948 | A | * | 2/1974 | Ratkovich |
| 4,749,198 | A | | 6/1988 | Brailean |
| 4,858,935 | A | | 8/1989 | Capson |
| D309,119 | S | | 7/1990 | Kremitzki |
| 4,951,952 | A | * | 8/1990 | Saddler |
| RE33,470 | E | | 12/1990 | Boy et al. |
| 4,976,442 | A | | 12/1990 | Treadway |
| 5,157,405 | A | | 10/1992 | Wycoff et al. |
| 5,294,131 | A | * | 3/1994 | Manske |
| 5,446,467 | A | * | 8/1995 | Willett |
| 5,450,614 | A | | 9/1995 | Rodriquez |

* cited by examiner

*Primary Examiner*—John A. Ricci

(57) ABSTRACT

A hunting arrow tracking system for tracking location of a game animal which was shot with an arrow. The hunting arrow tracking system includes an arrowhead member including a tubular member having a side wall, an open front end, a closed back end, and a bore being disposed in the tubular member through the open front end; and also includes a piston member being movably disposed in the bore of the tubular member; and further includes a transmitter being removably disposed in the bore of the tubular member and being adapted to send out signals; and also includes a receiver unit including a housing member and being adapted to receive signals from the transmitter.

10 Claims, 3 Drawing Sheets

HUNTING ARROW TRACKING SYSTEM

BACKGROUND OF THE INVENTION

1. Field of the Invention

The present invention relates to an arrow tracker and more particularly pertains to a new hunting arrow tracking system for tracking location of a game animal which was shot with an arrow.

2. Description of the Prior Art

The use of an arrow tracker is known in the prior art. More specifically, an arrow tracker heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,976,442; U.S. Pat. No. 4,858,935; U.S. Pat. No. 5,157,405; U.S. Pat. No. Des. 309,119; U.S. Pat. No. 4,749,198; U.S. Pat. No. 5,450, 614; and U.S. Pat. No. Re. 33,470.

While these devices fulfill their respective, particular objectives and requirements, the aforementioned patents do not disclose a new hunting arrow tracking system. The inventive device includes an arrowhead member including a tubular member having a side wall, an open front end, a closed back end, and a bore being disposed in the tubular member through the open front end; and also includes a piston member being movably disposed in the bore of the tubular member; and further includes a transmitter being removably disposed in the bore of the tubular member and being adapted to send out signals; and also includes a receiver unit including a housing member and being adapted to receive signals from the transmitter.

In these respects, the hunting arrow tracking system according to the present invention substantially departs from the conventional concepts and designs of the prior art, and in so doing provides an apparatus primarily developed for the purpose of tracking location of a game animal which was shot with an arrow.

SUMMARY OF THE INVENTION

In view of the foregoing disadvantages inherent in the known types of arrow tracker now present in the prior art. the present invention provides a new hunting arrow tracking system construction wherein the same can be utilized for tracking location of a game animal which was shot with an arrow.

The general purpose of the present invention, which will be described subsequently in greater detail, is to provide a new hunting arrow tracking system which has many of the advantages of the arrow tracker mentioned heretofore and many novel features that result in a new hunting arrow tracking system which is not anticipated, rendered obvious, suggested, or even implied by any of the prior art arrow tracker, either alone or in any combination thereof.

To attain this, the present invention generally comprises an arrowhead member including a tubular member having a side wall, an open front end, a closed back end, and a bore being disposed in the tubular member through the open front end; and also includes a piston member being movably disposed in the bore of the tubular member; and further includes a transmitter being removably disposed in the bore of the tubular member and being adapted to send out signals; and also includes a receiver unit including a housing member and being adapted to receive signals from the transmitter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hunting arrow tracking system which has many of the advantages of the arrow tracker mentioned heretofore and many novel features that result in a new hunting arrow tracking system which is not anticipated, rendered obvious, suggested, or even implied by any of the prior art arrow tracker, either alone or in any combination thereof.

It is another object of the present invention to provide a new hunting arrow tracking system which may be easily and efficiently manufactured and marketed.

It is a further object of the present invention to provide a new hunting arrow tracking system which is of a durable and reliable construction.

An even further object of the present invention is to provide a new hunting arrow tracking system which is susceptible of a low cost of manufacture with regard to both materials and labor, and which accordingly is then susceptible of low prices of sale to the consuming public, thereby making such hunting arrow tracking system economically available to the buying public.

Still yet another object of the present invention is to provide a new hunting arrow tracking system which provides in the apparatuses and methods of the prior art some of the advantages thereof, while simultaneously overcoming some of the disadvantages normally associated therewith.

Still another object of the present invention is to provide a new hunting arrow tracking system for tracking location of a game animal which was shot with an arrow.

Yet another object of the present invention is to provide a new hunting arrow tracking system which includes an arrowhead member including a tubular member having a side wall, an open front end, a closed back end, and a bore being disposed in the tubular member through the open front end; and also includes a piston member being movably disposed in the bore of the tubular member; and further includes a transmitter being removably disposed in the bore of the tubular member and being adapted to send out signals; and also includes a receiver unit including a housing member and being adapted to receive signals from the transmitter.

Still yet another object of the present invention is to provide a new hunting arrow tracking system that aids the hunter in tracking a game animal which had been shot with the arrow.

Even still another object of the present invention is to provide a new hunting arrow tracking system that lodges the transmitter in the body of the game animal even if the arrowhead does not remain in the game animal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
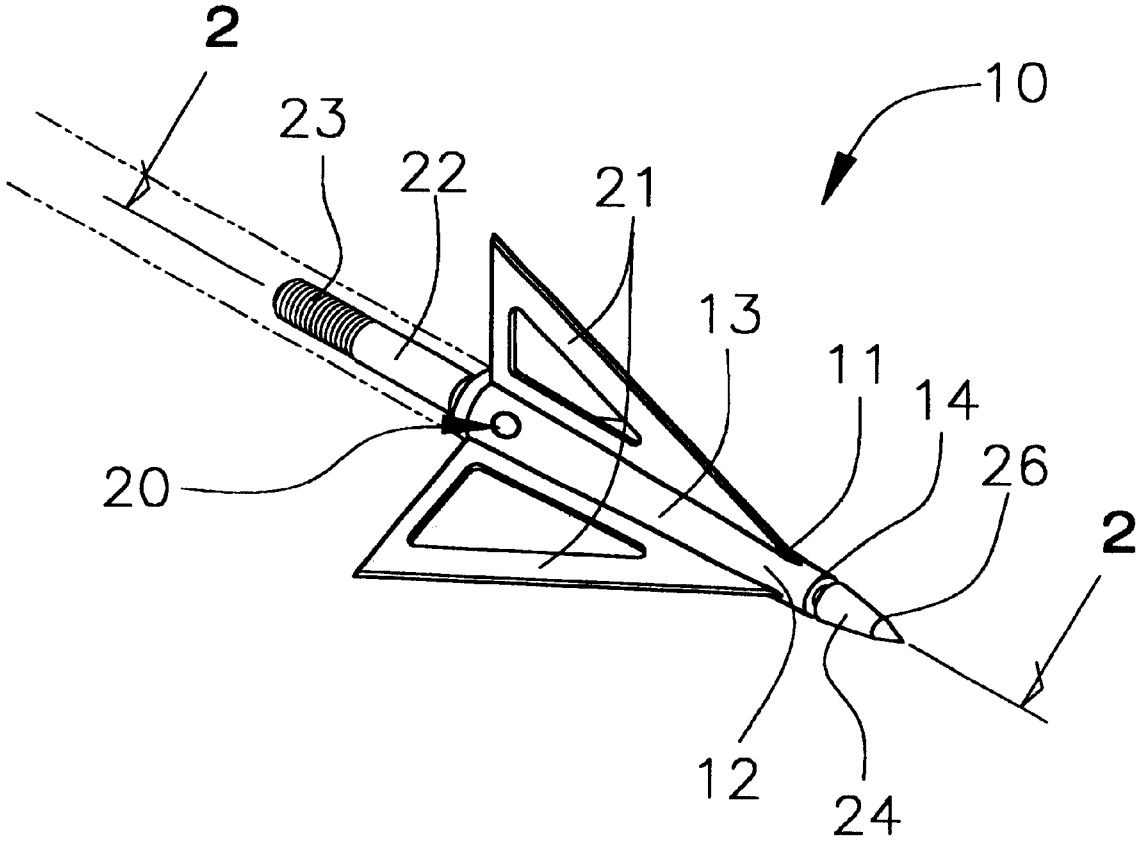
FIG. 1 is a perspective view of a hunting arrow of a new hunting arrow tracking system according to the present invention.
Figure 2:
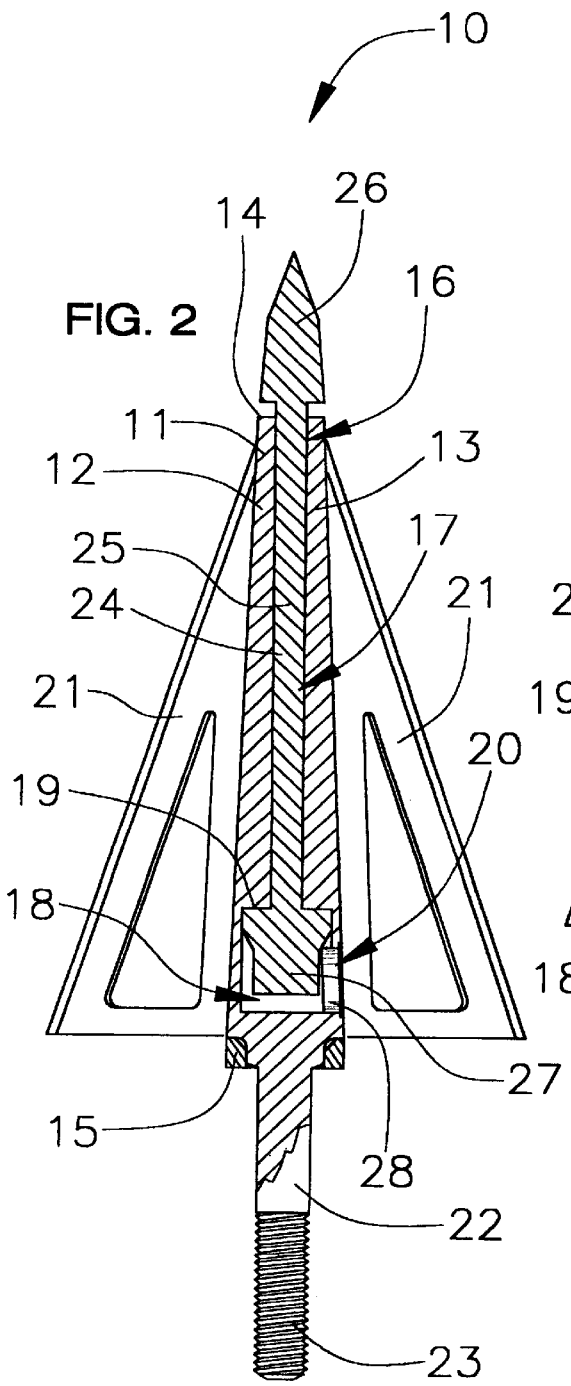
FIG. 2 is a cross-sectional view of the hunting arrow of the present invention showing the placement of the transmitter.
Figure 3:
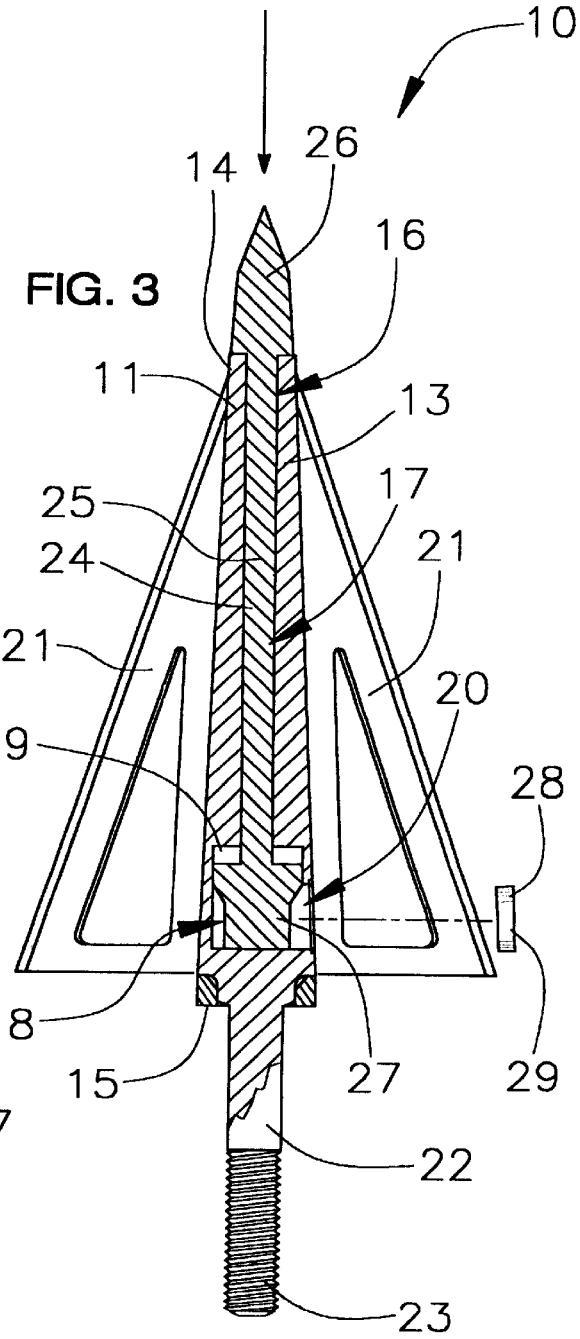
FIG. 3 is a cross-sectional view of the hunting arrow of the present invention showing the transmitter being removed.
Figure 4:
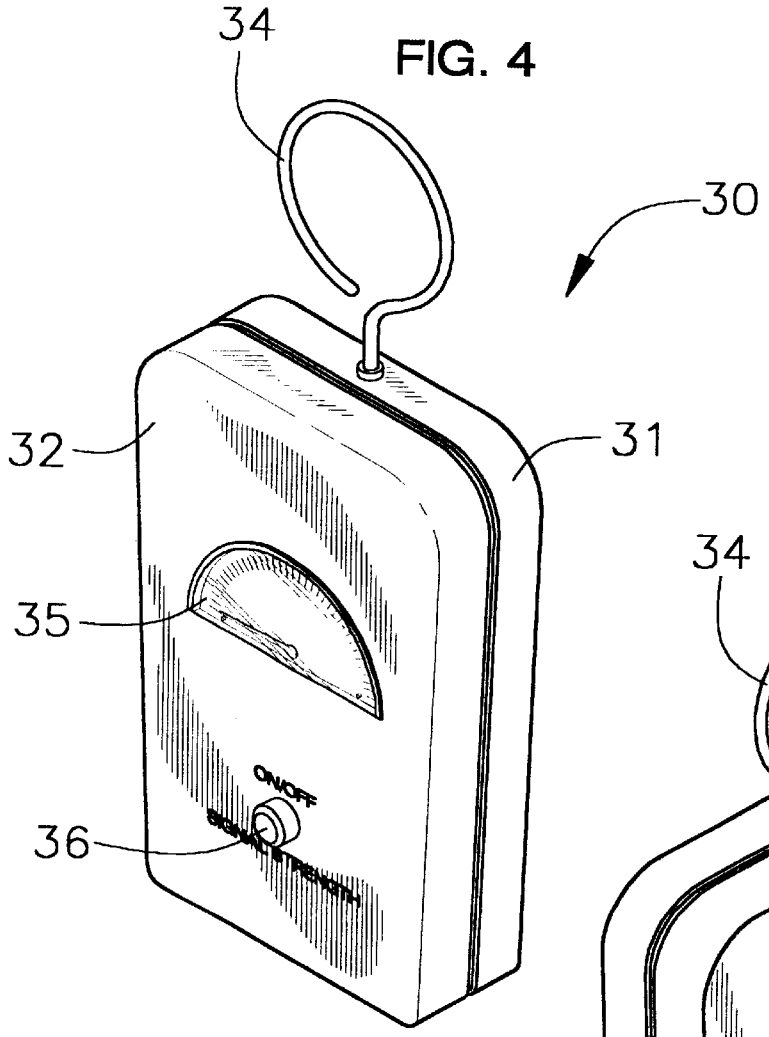
FIG. 4 is a front perspective view of the receiver unit of the present invention.
Figure 5:
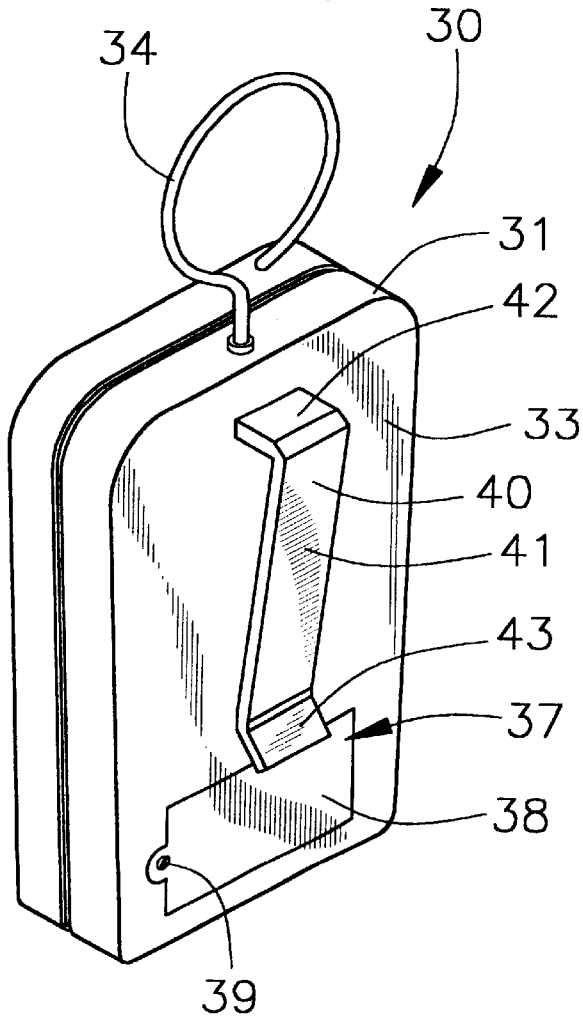
FIG. 5 is a rear perspective view of the receiver unit of the present invention.

With reference now to the drawings, and in particular to FIGS. 1 through 5 thereof, a new hunting arrow tracking system embodying the principles and concepts of the present invention and generally designated by the reference numeral 10 will be described.

As best illustrated in FIGS. 1 through 5, the hunting arrow tracking system 10 generally comprises an arrowhead member 11 including a tubular member 12 having a side wall 13, an open front end 14, a closed back end 15, and a bore 16 being disposed in the tubular member through the open front end 14. The bore 16 includes a main portion 17 and an enlarged back end portion 18 which is relatively larger than the main portion 17, and further includes an annular ledge 19 separating the main portion 17 from the enlarged back end portion 18. The tubular member 12 further includes an opening 20 being disposed through the side wall 13 and into the enlarged back end portion 18 of the bore 16. The arrowhead member 11 also includes broad-head members 21 being spaced about and being securely and conventionally attached to an exterior of the side wall 13 of the tubular member 12, and further includes a shaft 22 being securely and conventionally attached to an exterior of the closed back end 15 and extending outwardly therefrom with the shaft 22 having a threaded end portion 23 which is adapted to attach to an arrow.

A piston member 24 is movably disposed in the bore 16 of the tubular member 12. The piston member 24 includes a shaft portion 25 which is movably disposed in the bore 16, and also includes a broad-head portion 26 which is conventionally attached to a front end of the shaft portion 25 and which is larger than the bore 16, and further includes an enlarged back end portion 27 which is conventionally attached to a back end of the shaft portion 24 and which is movably disposed in the enlarged back end portion 18 of the bore 16 and which is prevented from moving out of the enlarged back end portion 18 of the bore 16 by the annular ledge 19. The enlarged back end portion 27 of the piston member 24 has a front and a back and is tapered inwardly toward the back thereof. A transmitter 28 is removably disposed in the bore 16 of the tubular member 12 and is adapted to send out signals. The transmitter 28 includes a disc-like housing 29 which is adapted to be urged through the opening 20 in the side wall 13 of the tubular member 12 upon impact by the enlarged back end portion 27 of the piston member 24.

A receiver unit 30 includes a housing member 31 and is adapted to receive signals from the transmitter 28. The receiver unit 30 further includes an antenna 34 being conventionally disposed in a wall of the housing member 30, and also includes a meter mechanism 35 being conventionally disposed in a front wall 32 of the housing member 30 for measuring and displaying strength of the signal being transmitted by the transmitter 28, and further includes a power switch 36 being movably and conventionally disposed in the front wall 32 of the housing member 31 and being conventionally connected to the meter mechanism 35, and also includes a clip member 40 being securely and conventionally attached to a back wall 33 of the housing member 31 and further includes a power source 39 such as a battery being removably disposed in the housing member 31 through an opening 37 in the back wall 33 of the housing member 31, and also includes a cover member 38 being removably and conventionally attached over the opening 37 in the back wall 33 of the housing member 31. The clip member 40 includes an elongate main portion 41, and also includes a first end portion 42 being angled relative to the elongate main portion 41 and being securely and conventionally attached to the housing member 31, and further includes a second end portion 43 being angled relative to the elongate main portion 41 and being movably biased against the housing member 31.

In use, the user places the transmitter 28 in the bore 16 of the tubular member 12 with the enlarged back end portion 27 of the piston member 24 being in contactable relationship with the annular ledge 19 in the bore 16. The user shoots the arrowhead member 11 into the game animal with the piston member 24 being forced rearwardly into the bore 16 and with the enlarged back end portion 27 of the piston member 24 impacting the transmitter 28 which is ejected out of the bore 16 through the opening 20 in the side wall 13 of the tubular member 12 and into the body of the game animal. As the critically-injured game animal runs off, the user turns on the receiver unit 30 to track the location of the game animal with the transmitter sending signals to the receiver unit 30. The meter mechanism 35 directs the user to the downed game animal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art. it is not desired to limit the invention to the exact construction and operation shown and described, and accordingly, all suitable modifications and equivalents may be resorted to, falling within the scope of the invention.

I claim:

1. A hunting arrow tracking system comprising:

an arrowhead member including a tubular member having a side wall, an open front end, a closed back end, and a bore being disposed in said tubular member through said open front end;

a piston member being movably disposed in said bore of said tubular member;

a transmitter being removably disposed in said bore of said tubular member and being adapted to send out signals; and a receiver unit including a housing member and being adapted to receive signals from said transmitter.

2. A hunting arrow tracking system as described in claim 1, wherein said bore includes a main portion and an enlarged back end portion which is relatively larger than said main portion, and further includes an annular ledge separating said main portion from said enlarged back end portion.

3. A hunting arrow tracking system as described in claim 2, wherein said tubular member further includes an opening being disposed through said side wall and into said enlarged back end portion of said bore.

4. A hunting arrow tracking system as described in claim 3, wherein said arrowhead member also includes broad-head members being sp aced about and being securely attached to an exterior of said side wall of said tubular member, and further includes a shaft being securely attached to an exterior of said closed back end and extending outwardly therefrom, said shaft having a threaded end portion which is adapted to attach to an arrow.

5. A hunting arrow tracking system as described in claim 2, wherein said piston member includes a shaft portion which is movably disposed in said bore, and also includes a broad-head portion which is attached to a front end of said shaft portion and which is larger than said bore, and further includes an enlarged back end portion which is attached to a back end of said shaft portion and which is movably disposed in said enlarged back end portion of said bore and which is prevented from moving out of said enlarged back end portion of said bore by said annular ledge.

6. A hunting arrow tracking system as described in claim 5, wherein said enlarged back end portion of said piston member has a front and a back and is tapered inwardly toward said back thereof.

7. A hunting arrow tracking system as described in claim 6, wherein said transmitter includes a disc-like housing which is adapted to be urged through said opening in said side wall of said tubular member upon impact by said enlarged back end portion of said piston member.

8. A hunting arrow tracking system as described in claim 1, wherein said receiver unit further includes an antenna being disposed in a wall of said housing member, and also includes a meter mechanism being disposed in a front wall of said housing member for measuring and displaying strength of the signal being transmitted by said transmitter, and further includes a power switch being movably disposed in said front wall of said housing member and being connected to said meter mechanism, and also includes a clip member being securely attached to a back wall of said housing member, and further includes a power source being removably disposed in said housing member through an opening in said back wall of said housing member, and also includes a cover member being removably attached over said opening in said back wall of said housing member.

9. A hunting arrow tracking system as described in claim 8, wherein said clip member includes an elongate main portion, and also includes a first end portion being angled relative to said elongate main portion and being securely attached to said housing member, and further includes a second end portion being angled relative to said elongate main portion and being movably biased against said housing member.

10. A hunting arrow tracking system comprising:

an arrowhead member including a tubular member having a side wall, an open front end, a closed back end, and a bore being disposed in said tubular member through said open front end, said bore including a main portion and an enlarged back end portion which is relatively larger than said main portion, and further includes an annular ledge separating said main portion from said enlarged back end portion, said tubular member further including an opening being disposed through said side wall and into said enlarged back end portion of said bore, said arrowhead member also including broad-head members being spaced about and being securely attached to an exterior of said side wall of said tubular member, and further including a shaft being securely attached to an exterior of said closed back end and extending outwardly therefrom, said shaft having a threaded end portion which is adapted to attach to an arrow;

a piston member being movably disposed in said bore of said tubular member, said piston member including a shaft portion which is movably disposed in said bore, and also including a broad-head portion which is attached to a front end of said shaft portion and which is larger than said bore, and further including an enlarged back end portion which is attached to a back end of said shaft portion and which is movably disposed in said enlarged back end portion of said bore and which is prevented from moving out of said enlarged back end portion of said bore by said annular ledge, said enlarged back end portion of said piston member having a front and a back and being tapered inwardly toward said back thereof;

a transmitter being removably disposed in said bore of said tubular member and being adapted to send out signals, said transmitter including a disc-like housing which is adapted to be urged through said opening in said side wall of said tubular member upon impact by said enlarged back end portion of said piston member; and a receiver unit including a housing member and being adapted to receive signals from said transmitter, said receiver unit further including an antenna being disposed in a wall of said housing member, and also including a meter mechanism being disposed in a front wall of said housing member for measuring and displaying strength of the signal being transmitted by said transmitter, and further including a power switch being movably disposed in said front wall of said housing member and being connected to said meter mechanism, and also including a clip member being securely attached to a back wall of said housing member, and further including a power source being removably disposed in said housing member through an opening in said back wall of said housing member, and also including a cover member being removably attached over said opening in said back wall of said housing member, said clip member including an elongate main portion, and also including a first end portion being angled relative to said elongate main portion and being securely attached to said housing member, and further including a second end portion being angled relative to said elongate main portion and being movably biased against said housing member.

* * * * *